US009536491B2

(12) United States Patent
Miyata et al.

(10) Patent No.: US 9,536,491 B2
(45) Date of Patent: Jan. 3, 2017

(54) LIQUID-CRYSTAL DISPLAY DEVICE

(71) Applicant: Sharp Kabushiki Kaisha, Osaka-shi, Osaka (JP)

(72) Inventors: Hidekazu Miyata, Osaka (JP); Yuichi Kita, Osaka (JP); Takatomo Yoshioka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 11 days.

(21) Appl. No.: 14/420,745

(22) PCT Filed: Sep. 20, 2013

(86) PCT No.: PCT/JP2013/075420
§ 371 (c)(1),
(2) Date: Feb. 10, 2015

(87) PCT Pub. No.: WO2014/050719
PCT Pub. Date: Apr. 3, 2014

(65) Prior Publication Data

US 2015/0206498 A1 Jul. 23, 2015

(30) Foreign Application Priority Data

Sep. 27, 2012 (JP) ..... 2012-214430

(51) Int. Cl.
*G09G 3/36* (2006.01)
*G09G 5/18* (2006.01)

(52) U.S. Cl.
CPC ..... *G09G 3/3696* (2013.01); *G09G 3/3614* (2013.01); *G09G 3/3666* (2013.01);
(Continued)

(58) Field of Classification Search
CPC .. G09G 3/3648; G09G 3/3614; G09G 3/3688; G09G 3/20
See application file for complete search history.

(56) References Cited

U.S. PATENT DOCUMENTS 6,621,489 B2 * 9/2003 Yanagisawa ..... G09G 3/3648 345/211
2006/0022932 A1 2/2006 Sagawa et al.
(Continued)

FOREIGN PATENT DOCUMENTS

JP 2000163025 A 6/2000
JP 2000-214830 A 8/2000
(Continued)

OTHER PUBLICATIONS

International Search Report PCT/ISA/210 for International Application No. PCT/JP2013/075420 dated Nov. 28, 2013.
(Continued)

*Primary Examiner* — Kumar Patel
*Assistant Examiner* — Mansour M Said
(74) *Attorney, Agent, or Firm* — Harness, Dickey & Pierce, P.L.C.

(57) ABSTRACT

A source driver generates a plurality of gradation voltages based on a plurality of gradation reference voltages VH255 to VL255 generated by a gradation reference voltage generation circuit, and drives the data lines using the generated gradation voltages. The control unit sets a waiting time before the power of the source driver is cut off, and controls the gradation reference voltage generation circuit such that all the plurality of gradation reference voltages VH255 to VL255 become the same voltage during the waiting time. In this way, the same voltages are written into the pixel circuits and the charge remaining in the pixel circuits are discharged, and thus, an afterimage, a ghosting, and a flickering caused by the remaining charge when the power is cut off are prevented.

8 Claims, 9 Drawing Sheets

(52) U.S. Cl.
CPC ..... *G09G 3/3674* (2013.01); *G09G 3/3688* (2013.01); *G09G 5/18* (2013.01); *G09G 2320/0247* (2013.01); *G09G 2320/0257* (2013.01); *G09G 2330/027* (2013.01)

(56) References Cited

U.S. PATENT DOCUMENTS

| | | | | |
|---|---|---|---|---|
| 2006/0279498 | A1* | 12/2006 | Kaneda | G09G 3/3696 345/89 |
| 2010/0013749 | A1* | 1/2010 | Huang | G09G 3/3648 345/89 |
| 2010/0177081 | A1* | 7/2010 | Lee | G09G 3/20 345/211 |

FOREIGN PATENT DOCUMENTS

| | | | |
|---|---|---|---|
| JP | 2001159876 | A | 6/2001 |
| JP | 2002-207455 | A | 7/2002 |
| JP | 2003-50565 | A | 2/2003 |
| JP | 2005-234495 | A | 9/2005 |
| JP | 2005-250034 | A | 9/2005 |
| JP | 2005-274868 | A | 10/2005 |
| JP | 2006047500 | A | 2/2006 |
| JP | 2007-65134 | A | 3/2007 |

OTHER PUBLICATIONS

Written Opinion of the International Searching Authority PCT/ISA/237 for International Application No. PCT/JP2013/075420 dated Nov. 28, 2013.

* cited by examiner

LIQUID-CRYSTAL DISPLAY DEVICE

CROSS-REFERENCE TO RELATED APPLICATIONS

This is a National Phase Application of PCT/JP2013/075420 filed Sep. 20, 2013, which claims priority to JP Application No. 2012-214430 filed on Sep. 27, 2012, the entire contents of each of which are hereby incorporated by reference.

TECHNICAL FIELD

The present invention relates to a display device, particularly to an active matrix type liquid-crystal display device.

BACKGROUND ART

An active matrix type liquid-crystal display device has a structure in which pixel circuits that include a liquid-crystal capacitor and a writing control thin film transistor (TFT) are arranged in a two-dimensional form. In a liquid-crystal display device in the related art, the TFT is formed using, for example, amorphous silicon. In recent years, a technology for forming the TFT using an oxide semiconductor such as indium gallium zinc oxide (IGZO) has been developed. The TFT formed using an oxide semiconductor is characterized in that a leakage current during OFF time is smaller than that in the TFT in the related art. Therefore, according to the liquid-crystal display device in which the TFT is formed using the oxide semiconductor, it is possible to improve the display quality from that in the liquid-crystal display device in the related art.

In the liquid-crystal display device, there is a problem in that an afterimage, a ghosting, and a flickering occur on a display screen. When a DC voltage is applied to a liquid-crystal layer, a movement of charge due to ionic conductivity is induced in the liquid-crystal layer, and the moved charge is accumulated on the alignment film that is applied on electrodes. When the voltage caused by the charge accumulated on the alignment film that is applied on the electrodes is applied between the electrodes (liquid-crystal layer), afterimages and ghosting occur. In the related art, in order to prevent afterimages or ghosting, the liquid-crystal display device performs an AC drive (polarity inversion drive) in which the polarity of the voltage written into the pixel electrode is switched at a predetermined interval. In the AC drive, when the polarities are positive and negative, the same amounts of voltage (the voltages of which the absolute values are the same) are applied. However, even when the same amounts of voltage are applied at the time of the polarities are positive and negative, the electric potentials (absolute values) between the electrodes are slightly different due to an affection of the load such as TFT characteristics or a panel wiring. For this reason, a difference corresponding to the period of the polarity inversion appears in the display luminance, and thus, a deterioration of display quality called a flickering occurs. In the related art, in order to prevent the flickering, the liquid-crystal display device has a function of adjusting the level of the voltage written into the pixel electrode for each polarity.

In addition, in the liquid-crystal display device, when the power is cut off, there is a problem that unnecessary charge remains in the pixel electrode, and thus, afterimages and ghosting occur. In PTL 1, as a method for preventing the afterimage in the liquid-crystal display device, a method is disclosed, in which, when the power is cut off, the voltages in all the gate lines are controlled such that they are in a level that the writing control TFT becomes temporary in ON state. Specifically, as illustrated in FIG. 10, a transistor Tr1 is provided corresponding to a gate line 91, and a power source voltage and voltages of control lines VH1 and VH2 are changed as illustrated in FIG. 11. In this way, when the power is cut off, the transistor Tr1 is controlled such that they are in ON state, the voltage in the gate line 91 is a high level, the writing control TFT 92 in the pixel circuit is in ON state, and thus, the charge remaining in the pixel electrode 93 can be discharged via a source line 94.

CITATION LIST

Patent Literature

PTL 1: Japanese Unexamined Patent Application Publication No. 2002-207455

SUMMARY OF INVENTION

Technical Problem

However, in the liquid-crystal display device described in PTL 1, after the power is cut off, the slight charge remains in the pixel electrode, and an amount of charge remaining in the pixel electrode varies depending on the pixel circuits. For this reason, in the liquid-crystal display device disclosed in PTL 1, it is not possible to sufficiently prevent the afterimage, the ghosting, and the flickering. Particularly, in the liquid-crystal display device in which the TFT is formed using the oxide semiconductor, since the leakage current when the writing control TFT is in an OFF state is small, the remaining charge in the pixel electrode when the power is cut off continues to remain over a long period of time (for example, even for a few days). As a result, the problem that the afterimages and the like cannot be sufficiently prevented is remarkable in the liquid-crystal display device in which the TFT is formed using the oxide semiconductor.

Therefore, an object of the present invention is to provide a liquid-crystal display device in which the afterimage, the ghosting, and the flickering caused by remaining charge when the power is cut off can effectively be prevented.

Solution to Problem

According to a first aspect of the present invention, a liquid-crystal display device which is an active matrix type liquid-crystal display device includes: a liquid-crystal panel that includes a plurality of scanning lines, a plurality of data lines, and a plurality of pixel circuits; a scanning line driving circuit that drives the scanning lines; a gradation reference voltage generation circuit that generates a plurality of gradation reference voltages; a data line driving circuit that generates a plurality of gradation voltages based on the plurality of gradation reference voltages, and drives the data lines using the generated gradation voltages; and a control unit that, when a power cut-off instruction is received, sets a waiting time before a power of the data line driving circuit is cut off, and controls the gradation reference voltage generation circuit such that all the plurality of gradation reference voltages become the same first voltage during the waiting time.

According to a second aspect of the present invention, in the liquid-crystal display device according to the first aspect of the present invention, the control unit sets the waiting time before the power of the data line driving circuit is cut off and the power of the scanning line driving circuit is cut off.

According to a third aspect of the present invention, in the liquid-crystal display device according to the first aspect of the present invention, the first voltage is a summed voltage in which a pull-in voltage generated at the time of writing into the pixel circuits is added to the voltage applied to a counter electrode of the liquid-crystal panel.

According to a fourth aspect of the present invention, in the liquid-crystal display device according to the first aspect of the present invention, the first voltage is an average voltage of a positive lowest gradation reference voltage and a negative lowest gradation reference voltage.

According to a fifth aspect of the present invention, in the liquid-crystal display device according to the first aspect of the present invention, a length of the waiting time is equal to or longer than one second.

According to a sixth aspect of the present invention, in the liquid-crystal display device according to the first aspect of the present invention, the gradation reference voltage generation circuit includes a plurality of D/A converters each of which converts assigned digital values to one gradation reference voltage, and during the waiting time, the control unit assigns the digital values corresponding to the first voltage to all the D/A converters included in the gradation reference voltage generation circuit.

According to a seventh aspect of the present invention, in the liquid-crystal display device according to the first aspect of the present invention, the gradation reference voltage generation circuit includes a plurality of operational amplifiers each of which outputs one gradation reference voltage and a plurality of switching circuits each of which outputs any of gradation reference voltages output from the operational amplifiers and the first voltage, and during the waiting time, the control unit controls all the switching circuits so as to output the first voltage.

According to an eighth aspect of the present invention, in the liquid-crystal display device according to the first aspect of the present invention, the liquid-crystal display device further includes a plurality of transistors that correspond to the scanning lines. One conductive terminal of the transistor is connected to the corresponding scanning line, the other conductive terminals of the transistors are commonly connected to a first control line, and the control terminals of all the transistors are commonly connected to a second control line. The control unit performs the control of: setting the waiting time before the power of the data line driving circuit is cut off and after the power of the scanning line driving circuit is cut off; applying the voltage for selecting the scanning lines to the first control line during the waiting time; and applying the voltage for causing the transistors to be conductive to the second control line.

Advantageous Effects of Invention

According to the first aspect of the present invention, by making all the gradation reference voltages that are references of the gradation voltages be the same voltage before the power of the data line driving circuit is cut off, the same voltages are written into the pixel circuits of the liquid-crystal panel and the charge remaining in the pixel circuits can be discharged. In addition, even in a case where the slight charge remains in the pixel circuits, the amount of remaining charge can be equalized among the pixel circuits. Therefore, it is possible to effectively prevent the afterimages, the ghosting, and the flickerings caused by the remaining charge when the power is cut off.

According to the second aspect of the present invention, during the waiting time, the scanning line driving circuit and the data line driving circuit operate in a state in which all the gradation reference voltages are the same voltage. Therefore, during the waiting time, the same voltage is written into the pixel circuits in order, and the charge remaining in the pixel circuits are discharged, and thus, it is possible to effectively prevent the afterimages, the ghosting, and the flickerings caused by the remaining charge when the power is cut off.

According to the third and fourth aspects of the present invention, during the waiting time, by applying a voltage of almost zero volts to the liquid-crystal layer of the liquid-crystal panel and reducing the charge remaining in the pixel circuits, it is possible to effectively prevent the afterimages, the ghosting, and the flickerings caused by the remaining charge when the power is cut off.

According to the fifth aspect of the present invention, by making all the gradation reference voltages be the same voltage for equal to or longer than one second before the power of the data line driving circuit is cut off, the same voltages are written into the pixel circuits multiple times and the charge remaining in the pixel circuits can reliably be discharged. Therefore, it is possible to effectively prevent the afterimages, the ghosting, and the flickerings caused by the remaining charge when the power is cut off.

According to the sixth aspect of the present invention, in the liquid-crystal display device that generates the gradation reference voltages using the D/A converters, it is possible to effectively prevent the afterimages, the ghosting, and the flickerings caused by the remaining charge when the power is cut off.

According to the seventh aspect of the present invention, in the liquid-crystal display device that generates the gradation reference voltages using the operational amplifiers, it is possible to effectively prevent the afterimages, the ghosting, and the flickerings caused by the remaining charge when the power is cut off.

According to the eighth aspect of the present invention, during the waiting time, all the scanning lines are selected in a state in which all the gradation reference voltages are the same. Therefore, during the waiting time, the same voltages are simultaneously written into the pixel circuits and the charge remaining in the pixel circuits are discharged, and thus, it is possible to effectively prevent the afterimages, the ghosting, and the flickerings caused by the remaining charge when the power is cut off.

DESCRIPTION OF EMBODIMENTS

First Embodiment

Figure 1:
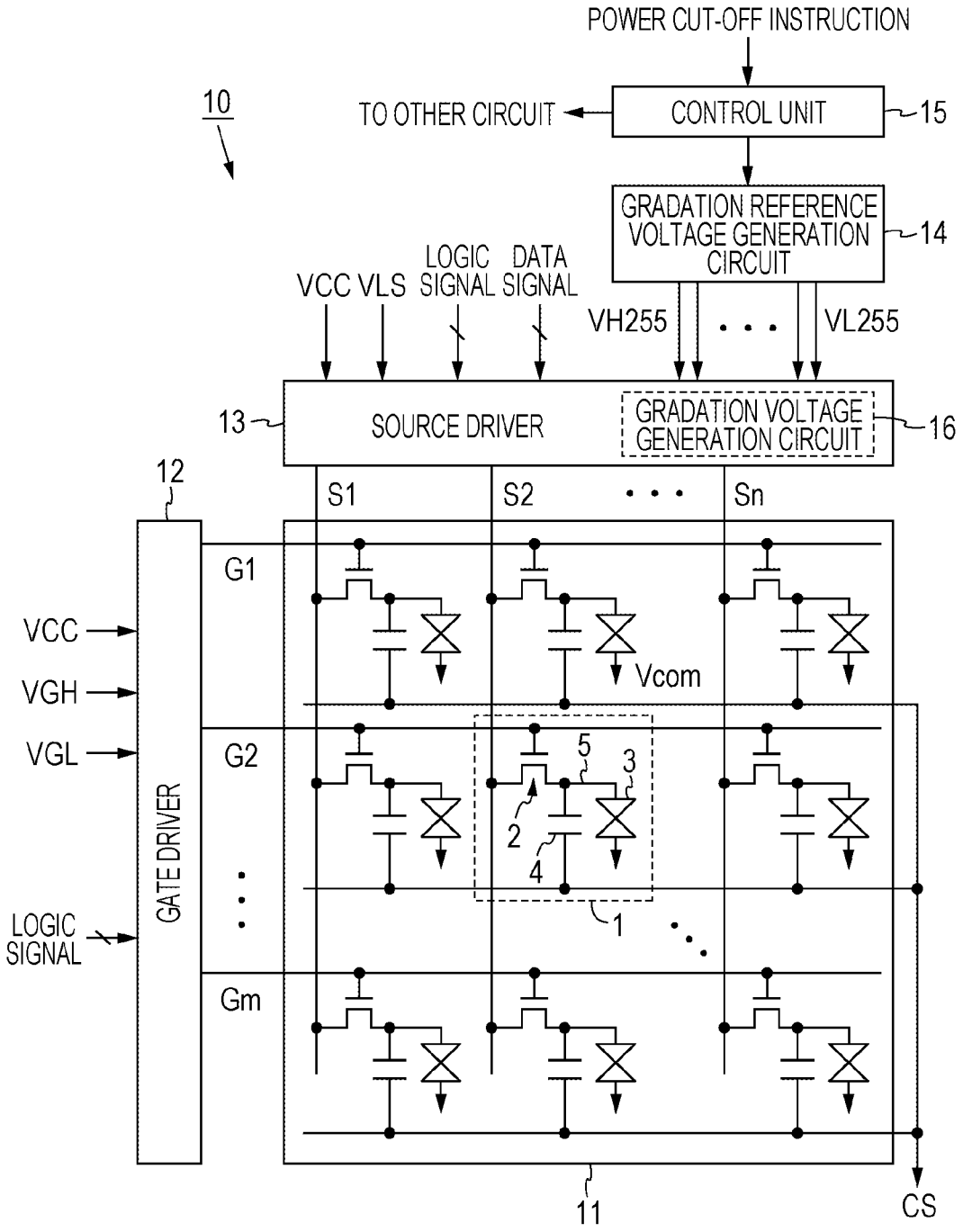
FIG. 1 is a block diagram illustrating a configuration of a liquid-crystal display device in a first embodiment of the present invention.

FIG. 1 is a block diagram illustrating a configuration of a liquid-crystal display device in a first embodiment of the present invention. A liquid-crystal display device 10 illustrated in FIG. 1 includes a liquid-crystal panel 11, a gate driver 12, a source driver 13, a gradation reference voltage generation circuit 14, and a control unit 15. Hereinafter, m and n are assumed to be integers equal to or greater than 2, i is an integer equal to or greater than 1 and smaller than m, and j is an integer equal to or greater than 1 and smaller than n.

The liquid-crystal panel 11 includes m gate lines G1 to Gm, n source lines S1 to Sn, and (m×n) pieces of pixel circuits 1. The (m×n) pieces of pixel circuits 1 are arranged line by line as n pieces in a row direction (a horizontal direction in FIG. 1) and m pieces in a column direction (a vertical direction in FIG. 1). The gate lines G1 to Gm extend in the row direction and are arranged in parallel with each other. The source lines S1 to Sn extend in the column direction and are arranged in parallel with each other so as to be orthogonal to the gate lines G1 to Gm. The gate line Gi is commonly connected to n pieces of pixel circuits 1 arranged on an $i_{th}$ row, and the source line Sj is commonly connected to m pieces of pixel circuits 1 arranged on a $j_{th}$ column.

The pixel circuit 1 includes a TFT 2, a liquid-crystal capacitor 3, and an auxiliary capacitor 4. The TFT 2 is an N-channel type TFT and functions as a writing control TFT. In the pixel circuit 1 arranged on the $i_{th}$ row and the $j_{th}$ column, a gate terminal of the TFT 2 is connected to the gate line Gi, and a source terminal of the TFT 2 is connected to the source line Sj. A drain terminal of the TFT 2 is connected to one electrode (hereinafter, referred to as a pixel electrode 5) of the liquid-crystal capacitor 3 and one electrode of the auxiliary capacitor 4. The other electrode of the liquid-crystal capacitor 3 is a counter electrode (not illustrated) common to all the pixel circuits 1. The other electrode of the auxiliary capacitor 4 is connected to an auxiliary capacity line. A counter electrode voltage Vcom is applied to the counter electrode, and an auxiliary capacity counter voltage CS is applied to the auxiliary capacity line.

The gate driver 12 drives the gate lines G1 to Gm. Specifically, a logic power source voltage VCC, a gate high voltage VGH, and a gate low voltage VGL are supplied to the gate driver 12 from the power supply circuit (not illustrated). In addition, a logic signal including a gate start pulse and a gate clock is supplied to the gate driver 12 from a dynamic control circuit (not illustrated). The gate driver 12 selects one gate line from the gate lines G1 to Gm based on the supplied logic signal in ascending order (or in descending order), and applies the gate high voltage VGH to the selected gate line and supplies the gate low voltage VGL to the remaining gate lines.

The gradation reference voltage generation circuit 14 generates a plurality of gradation reference voltages which are references of the gradation voltages output from the source driver 13. A plurality of positive gradation reference voltages and a plurality of negative gradation reference voltages are included in the plurality of gradation reference voltages generated in the gradation reference voltage generation circuit 14. The plurality of gradation reference voltages generated in the gradation reference voltage generation circuit 14 is supplied to the source driver 13. Hereinafter, the gradation reference voltage generation circuit 14 is assumed to generate a plurality of gradation reference voltages VH255 to VL255.

The source driver 13 includes a gradation voltage generation circuit 16. The gradation voltage generation circuit 16 generates a plurality of gradation voltages based on the reference voltages VH255 to VL255 generated in the gradation reference voltage generation circuit 14. In addition, the logic power source voltage VCC and a source output power source voltage VLS are supplied to the source driver 13 from the power supply circuit. Furthermore, the logic signal including the source start pulse and the source clock and data signal corresponding to the display data are supplied to the source driver 13 from the dynamic control circuit. The source driver 13 selects one gradation voltage from the plurality of gradation voltages generated in the gradation voltage generation circuit 16 for each source line based on the supplied logic signal and the data signal, and applies a total of n gradation voltages with respect to the source line S1 to Sn. As described above, the source driver 13 generates a plurality of gradation voltages based on the gradation reference voltages VH255 to VL255 generated in the gradation reference voltage generation circuit 14, and drives the data lines S1 to Sn using the generated plurality of gradation voltages.

During a period of selecting the gate line Gi (a period in which the gate high voltage VGH is applied to the gate line Gi), the TFTs 2 included in the n pieces of pixel circuits 1 arranged in the $i_{th}$ row are in ON state. During this period, the source driver 13 applies n gradation voltages subject to be written into the pixel electrode 5 included in n pieces of pixel circuits 1 arranged in the $i_{th}$ row, to the source lines S1 to Sn. In this way, the gradation voltages are respectively written into n pixel electrodes 5 arranged in the $i_{th}$ row. By performing this processing m times within the period of one frame, the gradation voltages are respectively written into the pixel electrodes 5 included in the (m×n) pieces of pixel circuits 1, and a desired image can be displayed on the liquid-crystal panel 11.

The source driver 13 performs an AC drive in order to prevent the afterimages and the ghosting. Specifically, the source driver 13, when driving the source lines S1 to Sn, inverts the polarity of the gradation voltages written into the pixel electrodes 5 for each predetermined interval (for example, an interval of one frame) (switches to and from the positive and the negative polarities). As the AC drive, the source driver 13 may perform a frame inversion drive, a line inversion drive, or a dot inversion drive.

The control unit 15 controls an operation of the liquid-crystal display device 10. The control unit 15 supplies a power source voltage, the logic signal and the data signal to the gate driver 12 and the source driver 13. In addition, the control unit 15, when a power cut-off instruction is received, sets a waiting time before cutting off the power of the gate driver 12 and the source driver 13, and controls the gradation reference voltage generation circuit 14 such that all the gradation reference voltages VH255 to VL255 become the same voltage during the waiting time (details will be described below).

In FIG. 1, the gate driver 12 and the source driver 13 are provided outside the liquid-crystal panel 11. However, both or any of the gate driver 12 and the source driver 13 may be integrally formed with the liquid-crystal panel 11. In addition, the gate line, the source line, a gate driver, and a source driver are respectively referred to as a scanning line, a data line, a scanning line driving circuit, and a data line driving circuit.

Figure 2:
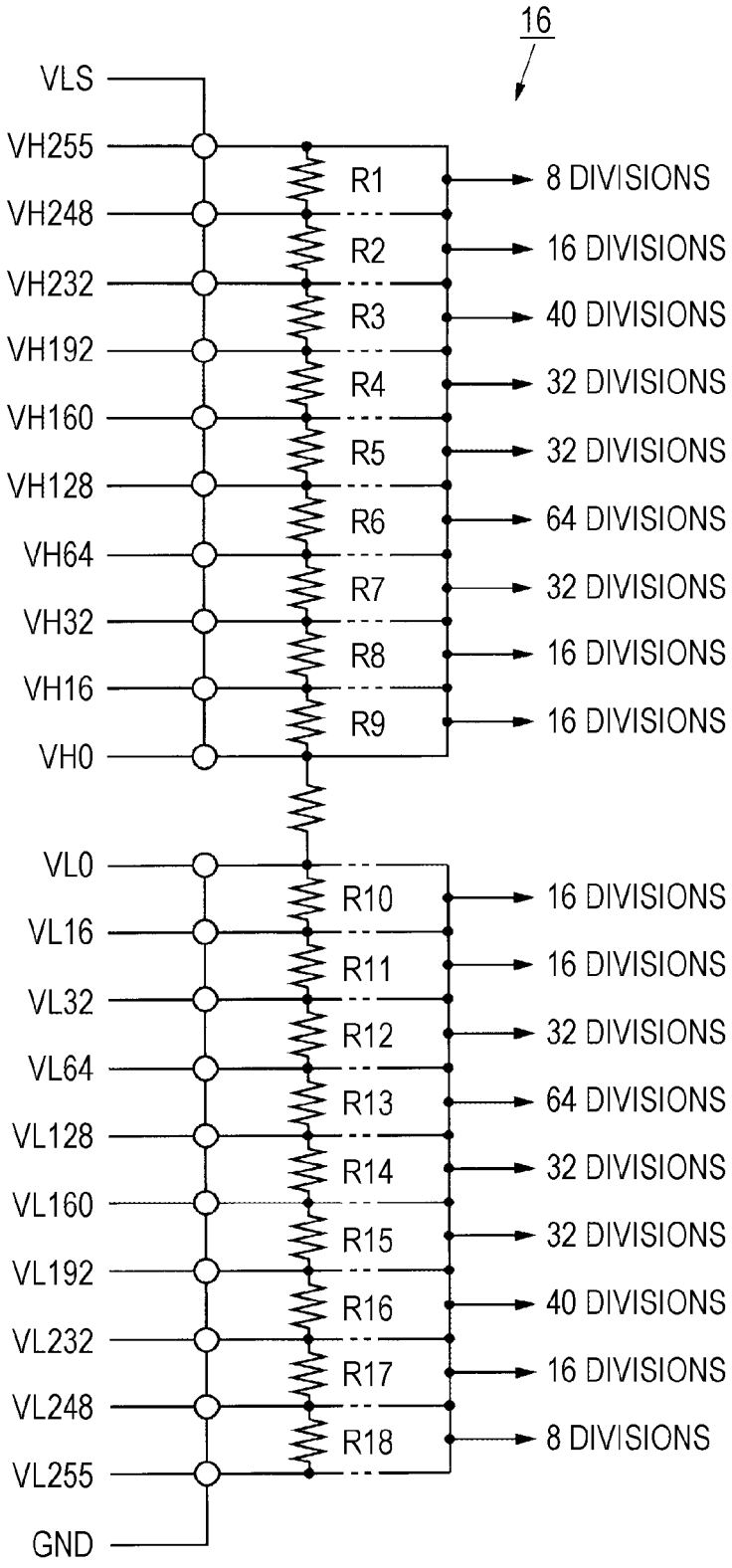
FIG. 2 is a diagram illustrating an example of a gradation voltage generation circuit included in the liquid-crystal display device illustrated in FIG. 1.

FIG. 2 is a diagram illustrating an example of the gradation voltage generation circuit 16 included in the source driver 13. Here, it is assumed that the width of the data signal is 8 bits and ten positive gradation reference voltages and ten negative gradation reference voltages are supplied to the gradation voltage generation circuit 16. VH0, VH16, VH32, VH64, VH128, VH160, VH192, VH232, VH248, and VH255 are supplied to the gradation voltage generation circuit 16 illustrated in FIG. 2 as the positive gradation reference voltages, and VL0, VL16, VL32, VL64, VL128, VL160, VL192, VL232, VL248, and VL255 are supplied as the negative gradation reference voltages. The gradation voltage generation circuit 16 includes eighteen resistor division circuits R1 to R18. The resistor division circuit R1 generates eight gradation voltages based on two voltages VH255 and VH248. The resistor division circuit R2 generates sixteen gradation voltages based on two voltages VH248 and VH232. Similarly, the resistor division circuits R3 to R18 generate a plurality of gradation voltages based on two voltages. As described above, the gradation voltage generation circuit 16 illustrated in FIG. 2 generates 256 positive gradation voltages and 256 negative gradation voltages using the resistor division circuits R1 to R18.

Figure 3:
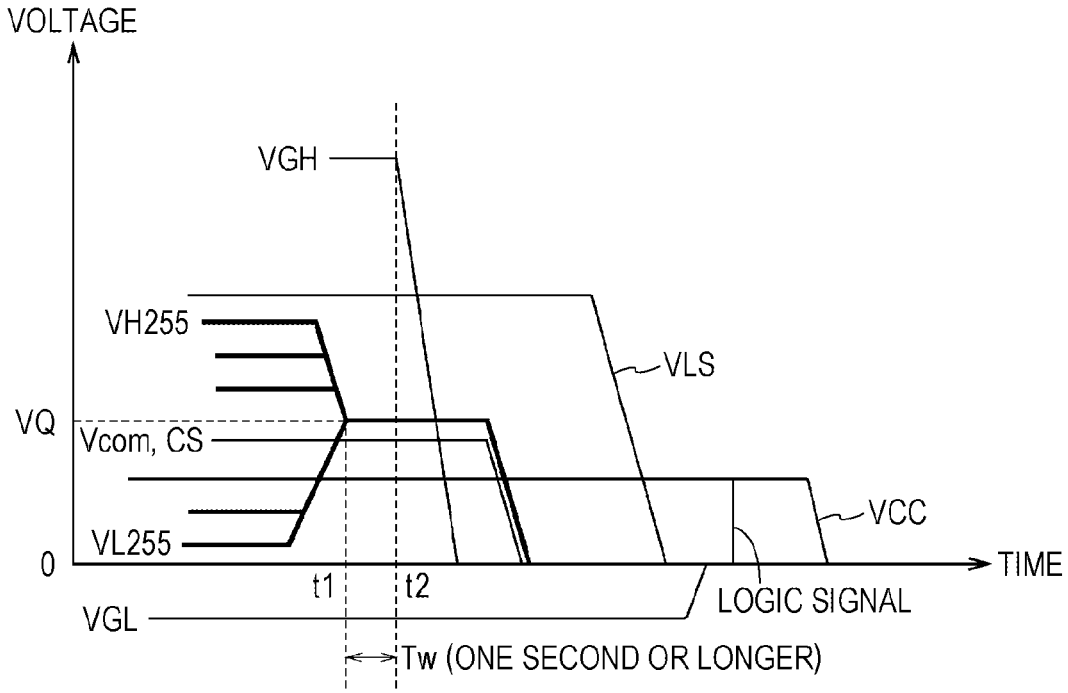
FIG. 3 is a diagram illustrating a power sequence of the liquid-crystal display device illustrated in FIG. 1 when the power is cut off.

Hereinafter, an operation of the liquid-crystal display device 10 when the power is cut off, which has the characteristics of the present embodiment, will be described. FIG. 3 is a diagram illustrating a power sequence of the liquid-crystal display device 10 when the power is cut off. In FIG. 3, changes of the voltages when the power is cut off are illustrated, these voltages being: the logic power source voltage VCC (the power source voltage supplied to the gate driver 12 and the source driver 13), the gate high voltage VGH, the gate low voltage VGL, the source output power source voltage VLS, the gradation reference voltages VH255 to VL255, the counter electrode voltage Vcom, the auxiliary capacity counter voltage CS, and the voltage of the logic signal (the logic signal supplied to the gate driver 12 and the source driver 13). In FIG. 3, the counter electrode voltage Vcom and the auxiliary capacity counter voltage CS are the same voltages.

In the power sequence in FIG. 3, at a point in time t1, all the gradation reference voltages VH255 to VL255 are changed to a voltage VQ. Next, at a point in time t2, the gate high voltage VGH starts to change toward zero volts (ground level). Next, the counter electrode voltage Vcom, the auxiliary capacity counter voltage CS, and all the gradation reference voltages VH255 to VL255 change to zero volts. After that, the source output power source voltage VLS, the gate low voltage VGL, the voltage of the logic signal, and the logic power source voltage VCC are changed to zero volts in this order. The power sequence illustrated in FIG. 3 is realized by the control unit 15.

A period from the point in time t1 to the point in time t2 set by the control unit 15 is referred to as a waiting time Tw. The length of the waiting time Tw is set to, for example, equal to or longer than one second (the reason thereof will be described below). In the present embodiment, the control unit 15 sets the waiting time Tw before the power of the source driver 13 is cut off and before the power of the gate driver 12 is cut off. During the waiting time Tw, since the power source voltage is continuously supplied to the gate driver 12 and the source driver 13, the gate driver 12 and the source driver 13 perform the same as the previous operation during the waiting time Tw. Specifically, during the waiting time Tw, the gate driver 12 drives the gate lines G1 to Gm and the source driver 13 drives the source lines S1 to Sn.

During the waiting time Tw, all the gradation reference voltages VH255 to VL255 generated in the gradation reference voltage generation circuit 14 are equal to the voltage VQ. For this reason, during the waiting time Tw, all the gradation voltage generated in the gradation voltage generation circuit 16 are also equal to the voltage VQ. Therefore, during the waiting time Tw, the source driver 13 always supplies the same voltage VQ to the source lines S1 to Sn regardless of the data signal. Since the length of the waiting time Tw is equal to or longer than one second, during the waiting time Tw, the voltage VQ is written into the pixel electrodes 5 included in the (m×n) pieces of the pixel circuits 1 multiple times. At this time, the charge remaining in the pixel electrode 5 are discharged via the source lines S1 to Sn.

Figure 4:
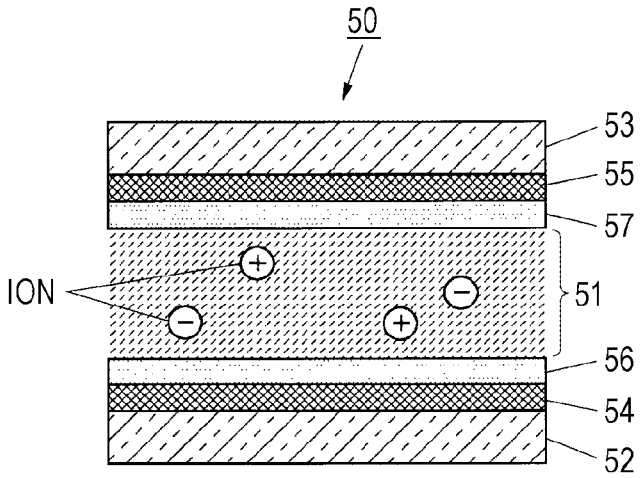
FIG. 4 is a cross-sectional diagram of a liquid-crystal panel.

Here, the afterimages, the ghosting, and the flickerings occurred in the liquid-crystal display device will be described. FIG. 4 is a cross-sectional diagram of a liquid-crystal panel. As illustrated in FIG. 4, a liquid-crystal panel 50 has a structure in which a liquid-crystal layer 51 is interposed between two sheets of glass substrates 52 and 53. The pixel electrode 54 and the alignment film 56 are provided on one glass substrate 52, and the counter electrode 55 and an alignment film 57 are provided on the other glass substrate 53.

In the pixel electrode of the liquid-crystal display device, a voltage of the source line is supplied to the pixel electrode 54 when the voltage of the gate line connected to the gate terminal of the writing control TFT is at the high level. However, the liquid-crystal layer 51 is not a perfect insulator. For this reason, when a DC voltage is applied to the liquid-crystal layer 51, ionic conduction occurs, and thus, the charge are accumulated on the interface (hereinafter, referred to as alignment film interface) between the liquid-crystal layer 51 and the alignment films 56 and 57. Therefore, the voltage applied to the liquid-crystal layer 51 is not exactly match the voltage which is being attempted to be applied from outside of the pixel circuit using the source driver. Since the transmittance of the liquid-crystal layer 51 varies according to the voltage applied to the liquid-crystal layer 51, if the voltage applied to the liquid-crystal layer 51 varies from a correct level, the afterimages or the ghosting occur.

In addition, by performing the AC drive, the positive gradation voltage and the negative gradation voltage having the same absolute value are written between the pixel electrode 54 and the counter electrode 55 for each predetermined time period (for example, for each frame period) in a switching manner. However, when the charge is accumulated on the alignment film interface, a difference in absolute values of the voltages applied to the liquid-crystal layer 51 occurs, between when the positive gradation voltage is written into and when the negative gradation voltage is written into. Therefore, the luminance of the pixel changes for every one frame and the changes of the luminance of the pixel is recognized as the flickering.

In the liquid-crystal panel described above, the pixel electrode and the counter electrode are respectively provided on different glass substrates. However, even if the pixel electrode and the counter electrode are provided on the same glass substrates, similar afterimages, the ghosting, and the flickerings occur.

Figure 5:
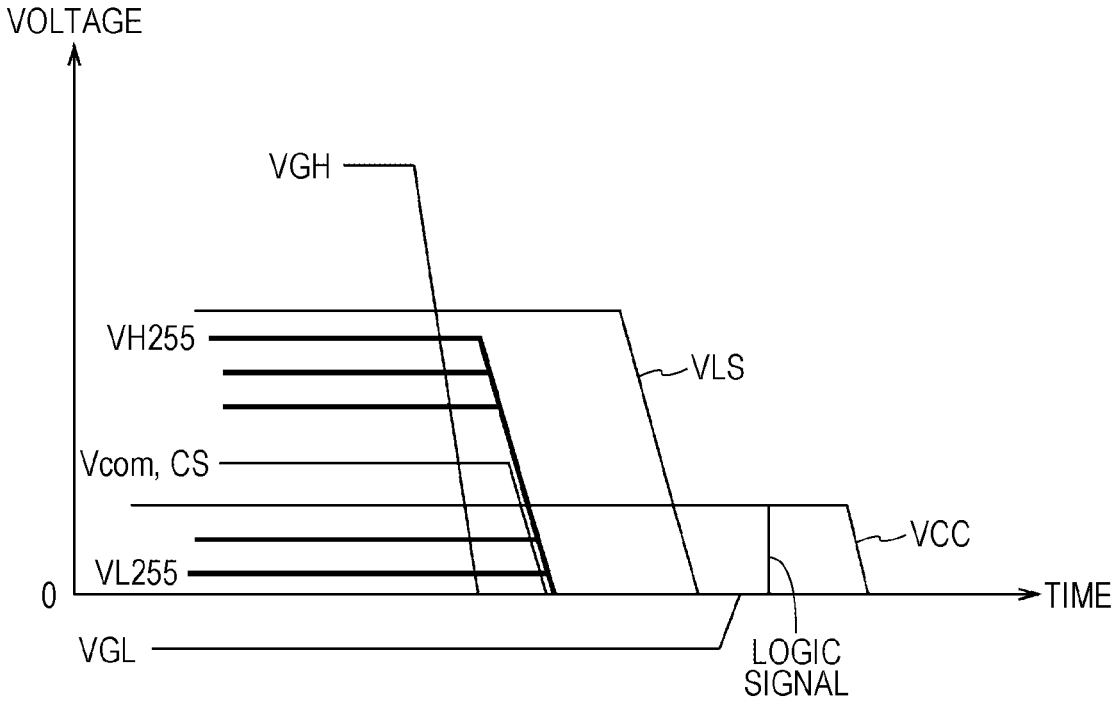
FIG. 5 is a diagram illustrating a power sequence of a liquid-crystal display device in a comparative example when the power is cut off.

Hereinafter, effects of the liquid-crystal display device 10 in the present embodiment will be described. Generally, the ghosting generated during the operation of the liquid-crystal display device can be prevented by the AC drive. However, in the liquid-crystal display device in the related art (for example, the liquid-crystal display device using the power sequence as illustrated in FIG. 5 when the power is cut off) on which no particular study has been performed when the power is cut off, the charge remains on the pixel electrode when the power is cut off, the DC voltage is applied to the liquid-crystal layer after the power is cut off, and then, the charge remains on the alignment film interface. Therefore, in the liquid-crystal display device in the related art, there is a problem in that the afterimages and the ghosting occur after the power is cut off, and then, the flickerings occur after the power is turned ON.

In the liquid-crystal display device disclosed in PTL 1, after the power is cut off, the slight charge remains in the pixel electrode, and the amount of charge remaining in the pixel electrode is different depending on the pixel circuits. For this reason, in the liquid-crystal display device disclosed in PTL 1, it is not possible to sufficiently prevent the afterimages, the ghosting, and the flickerings. This problem is prominent in the liquid-crystal display device formed using an oxide semiconductor such as IGZO.

In the liquid-crystal display device 10 in the present embodiment, when the power cut-off instruction is received, the control unit 15 sets the waiting time Tw before the power of the source driver 13 is cut off and before the power of the gate driver 12 is cut off, and controls the gradation reference voltage generation circuit 14 such that all the gradation reference voltages VH255 to VL255 become the same voltage VQ during the waiting time Tw. In the liquid-crystal display device 10, before the power of the gate driver 12 and the source driver 13 is cut off, the gate driver 12 and the source driver 13 operate for one second or longer in the state in which the gradation reference voltages VH255 to VL255 are controlled to be the same voltage VQ. Therefore, the voltage VQ can be written into all the pixel circuits 1 (all the pixel electrodes 5) included in the liquid-crystal panel 11 multiple times and it is possible to reliably discharge the charge remaining in the pixel electrodes 5 via the source lines S1 to Sn. In addition, even in a case where the slight charge remains in the pixel electrodes 5, the amount of the remaining charge can be made equal among the pixel circuits 1. Therefore, according to the liquid-crystal display device 10 in the present embodiment, it is possible to effectively prevent the afterimages, the ghosting, and the flickerings caused by the remaining charge when the power is cut off.

The voltage VQ is determined by the following method. Considering a pull-in voltage (a pulled-in amount of voltage due to the capacitive coupling of the gate line Gi and the pixel electrode 5) generated at the time of writing into the pixel circuits 1, during the waiting time Tw, it is preferable that the voltage of the pixel electrode 5 is higher than the counter electrode voltage Vcom by the amount of pull-in voltage generated at the time of writing into the pixel circuits 1. Specifically, it is preferable that the voltage of the pixel electrode 5 is higher than the counter electrode voltage Vcom by ΔVgh indicated in following Formula (1). Accordingly, it is preferable that the summed voltage (Vcom+ΔVgh) which is higher than the counter electrode voltage Vcom by ΔVgh is used as the voltage VQ.

$$\Delta Vgh = Cgd/\Sigma C \times (VGH - VGL) \quad (1)$$

Here, in Formula (1), Cgd represents the coupled capacity of the pixel electrode 5 and the gate line Gi, ΣC represents the total capacity coupled to the pixel electrode 5, VGH represents the gate high voltage, and VGL represents the gate low voltage.

In the actual liquid-crystal panel, since the gate high voltage VGH and the gate low voltage VGL change according to the wiring load of the panel, the preferred level of the gate high voltage VGH and the gate low voltage VGL is slightly different from the value calculated by the above formula. For this reason, in the actual liquid-crystal panel, it is preferable that the voltage VQ is determined based on the voltage in which the pulled-in amount is adjusted. From the above, it is preferable that an average voltage ((VH0+VL0)/2) of the positive lowest gradation reference voltage VH0 and the negative lowest gradation reference voltage VL0 which are adjusted for each liquid-crystal panel is used as the voltage VQ.

In addition, in the liquid-crystal display device 10, sometimes it takes approximately one frame period (16 milliseconds) from the time when the voltage applied to the liquid-crystal layer of the liquid-crystal panel 11 to the time when the dielectric constant of the liquid-crystal layer changes. In this case, the voltage of the pixel electrode 5 does not reach the written voltage by writing the voltage into the pixel electrode 5 only one time. For this reason, it is necessary that the length of the waiting time Tw is equal to or longer than three frame periods (equal to or longer than 50 milliseconds). In addition, depending on the display images, there is a case where the charge remains on the alignment film interface in the specific pixel circuits 1 of the liquid-crystal panel 11. Considering this case, it is preferable that the length of the waiting time Tw is equal to or longer than one second.

As described above, the liquid-crystal display device 10 in the present embodiment includes: the liquid-crystal panel 11 that includes a plurality of scanning lines (gate lines G1 to Gm), a plurality of data lines (source lines S1 to Sn), and a plurality of pixel circuits 1; the scanning line driving circuit (gate driver 12) that drives the scanning lines; the gradation reference voltage generation circuit 14 that generates a plurality of gradation reference voltages VH255 to VL255; the data line driving circuit (source driver 13) that generates a plurality of gradation voltages based on the plurality of gradation reference voltages VH255 to VL255, and drives the data lines using the generated gradation voltages; and the control unit 15 that, when a power cut-off instruction is received, sets the waiting time Tw before a power of the data line driving circuit is cut off and before a power of the scanning line driving circuit is cut off, and controls the gradation reference voltage generation circuit 14 such that all the plurality of gradation reference voltages VH255 to VL255 become the same voltage VQ during the waiting time Tw.

According to the liquid-crystal display device 10 in the present embodiment, during the waiting time Tw, in the state in which all the gradation reference voltages VH255 to VL255 which are the reference of the gradation voltages are the same voltage VQ, the scanning line dive circuit and the data line driving circuit operate. Therefore, during the waiting time Tw, it is possible to write the same voltage VQ into the pixel circuits 1 of the liquid-crystal panel 11 in order, and to discharge the charge remaining in the pixel circuits 1. In addition, even in a case where the slight charge remains in the pixel circuits 1, the amount of remaining charge can be made equal among the pixel circuits 1. Accordingly, it is possible to effectively prevent the afterimages, the ghosting, and the flickerings caused by the remaining charge when the power is cut off.

In addition, by using the summed voltage (Vcom+ΔVgh) in which the pull-in voltage generated at the time of writing into the pixel circuits 1 is added to the counter electrode voltage, or using the average voltage ((VH0+VL0)/2) of the positive lowest gradation reference voltage V and the negative lowest gradation reference voltage V as the voltage VQ, it is possible to apply the voltage of almost zero volts to the liquid-crystal layer of the liquid-crystal panel 11 during the waiting time, and thus, to reduce the charge remaining in the pixel circuits 1. In addition, by making the length of the waiting time Tw equal to or longer than one second, it is possible to write the same voltages to the pixel circuits 1 multiple times, and reliably discharge the charge remaining in the pixel circuits 1.

Second Embodiment

Figure 6:
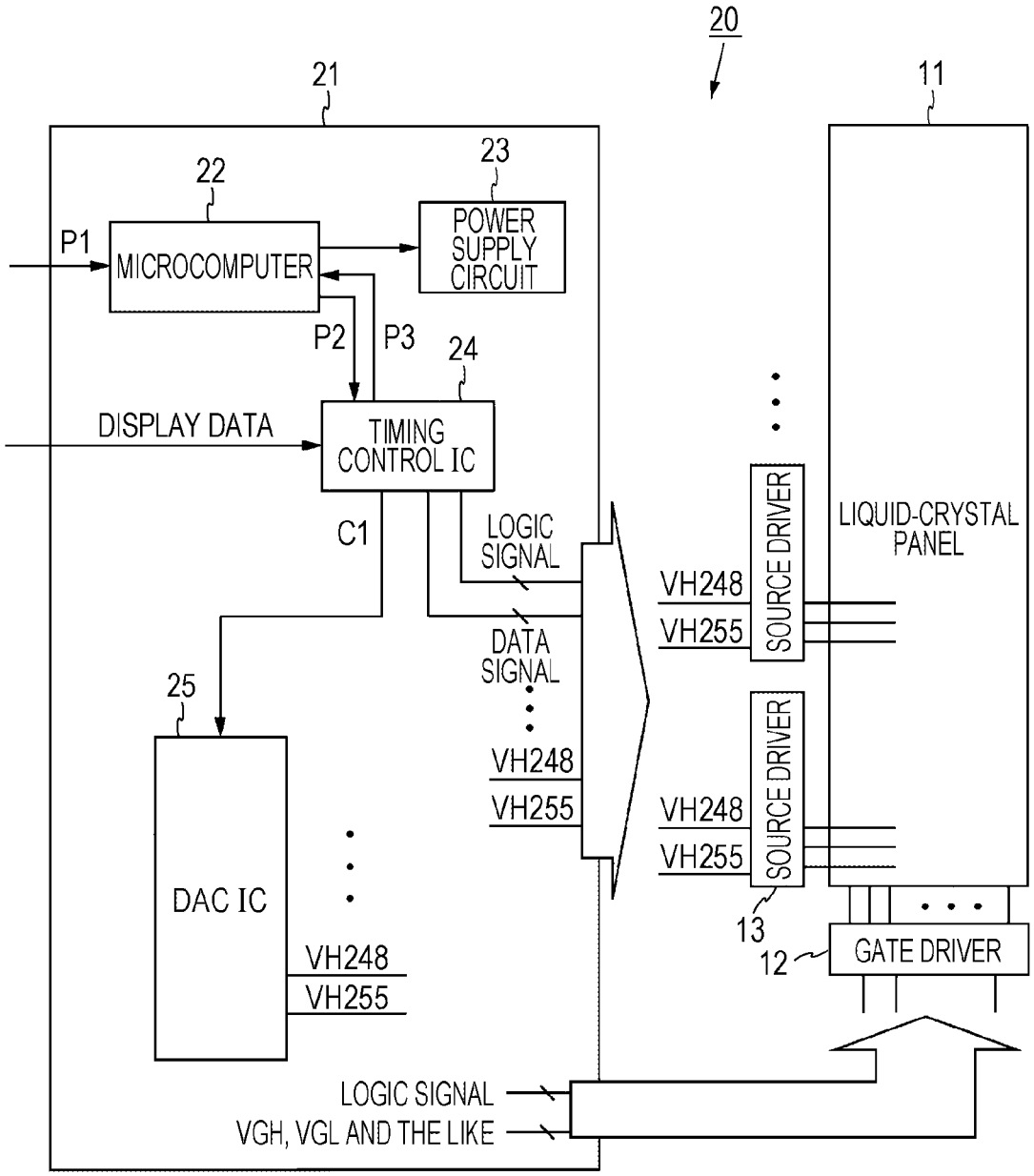
FIG. 6 is a block diagram illustrating a configuration of a liquid-crystal display device in a second embodiment of the present invention.

In the second and third embodiments, specific examples of the liquid-crystal display device in the first embodiment will be described. FIG. 6 is a block diagram illustrating a configuration of a liquid-crystal display device in the second embodiment of the present invention. A liquid-crystal display device 20 illustrated in FIG. 6 includes the liquid-crystal panel 11, the gate driver 12, the source driver 13, and a control board 21. In the embodiments described below, in the configuration elements in each embodiment, the same reference signs will be given to the same configuration elements as that in the embodiment described above, and the description thereof will not be repeated.

A microcomputer 22, the power supply circuit 23, a timing control IC 24, and a DAC IC 25 are mounted on the control board 21. The microcomputer 22 and the timing control IC 24 function as the control unit 15 illustrated in FIG. 1, and the DAC IC 25 functions as the gradation reference voltage generation circuit 14 illustrated in FIG. 1.

In the timing control IC 24, display data is input from the outside of the liquid-crystal display device 20. The timing control IC 24 outputs a logic signal (a synchronizing signal and a control signal) to the gate driver 12 and outputs the logic signal and the data signal corresponding to the display data to the source driver 13. In addition, the timing control IC 24 outputs a control signal C1 that indicates the digital value, to the DAC IC 25.

The DAC IC 25 includes a plurality of D/A converters (not illustrated). For example, in a case where twenty gradation reference voltages are generated, the DAC IC 25 includes at least twenty D/A converters. The timing control IC 24 respectively assigns twenty digital values corresponding to twenty gradation reference voltages to the twenty D/A converters included in the DAC IC 25 by outputting the control signal C1. Each of the D/A converters converts the digital values assigned by the timing control IC 24 to one gradation reference voltage. By using the DAC IC 25 including the plurality of D/A converters as described above, it is possible to generate the gradation reference voltages VH255 to VL255.

The microcomputer 22 controls the power supply circuit 23 and the timing control IC 24. The power supply circuit 23 generates the power source voltage supplied to the gate driver 12 and the source driver 13 in accordance with the control of the microcomputer 22.

When a control signal P1 that instructs the power cut-off is received from the outside of the liquid-crystal display device 30, the microcomputer 22 outputs a control signal P2 that instructs the power cut-off to the timing control IC 24. When the control signal P2 is received, the timing control IC 24 assigns the digital values corresponding to the voltage VQ to all the D/A converters included in the DAC IC 25. All the D/A converters included in the DAC IC 25 convert the digital values corresponding to the voltage VQ to the voltage VQ. Therefore, during the waiting time Tw, all the gradation reference voltages VH255 to VL255 output from the DAC IC 25 become the voltage VQ.

The timing control IC 24 outputs a control signal P3 that indicates the completion of preparing the power cut-off to the microcomputer 22 after the digital values corresponding to the voltage VQ are assigned to all the D/A converters included in the DAC IC 25. When the control signal P3 is received, the microcomputer 22 cuts off the power of the gate driver 12 and the source driver 13 in accordance with the power sequence illustrated in FIG. 3.

As described above, in the liquid-crystal display device 20 in the present embodiment, the gradation reference voltage generation circuit includes a plurality of D/A converters each of which converts the assigned digital values to one gradation reference voltage. During the waiting time Tw, the control unit (the microcomputer 22 and the timing control IC 24) assigns the digital values corresponding to voltage VQ to all the D/A converters included in the gradation reference voltage generation circuit. Therefore, according to the liquid-crystal display device 20 in the present embodiment, with regard to the liquid-crystal display device that generates the gradation reference voltage using the D/A converters, it is possible to effectively prevent the afterimages, the ghosting, and the flickerings caused by the remaining charge when the power is cut off.

Third Embodiment

Figure 7:
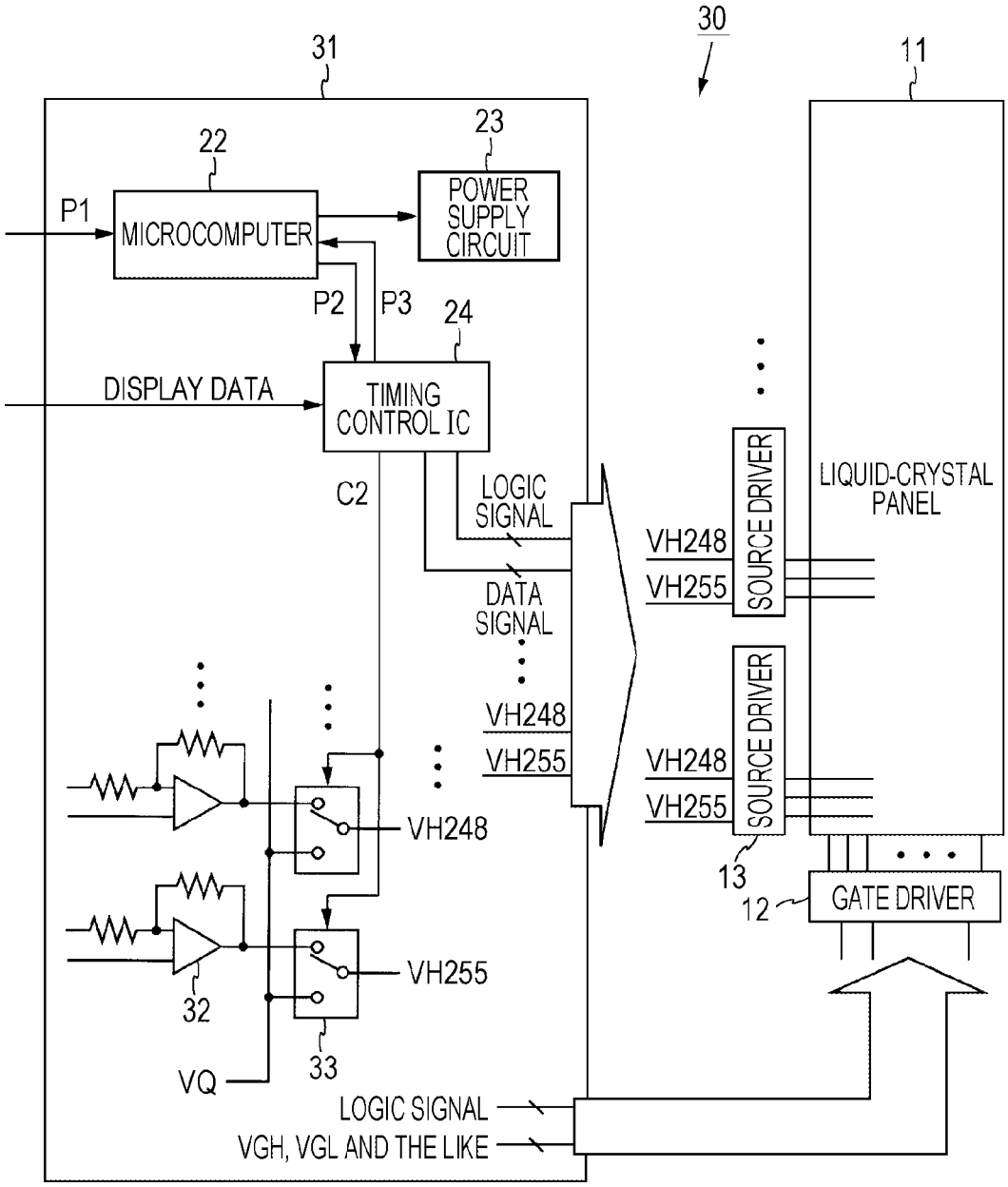
FIG. 7 is a block diagram illustrating a configuration of a liquid-crystal display device in a third embodiment of the present invention.

FIG. 7 is a block diagram illustrating a configuration of a liquid-crystal display device in a third embodiment of the present invention. The liquid-crystal display device 30 illustrated in FIG. 7 includes the liquid-crystal panel 11, the gate driver 12, the source driver 13, and a control board 31.

The microcomputer 22, the power supply circuit 23, the timing control IC 24, a plurality of operational amplifiers 32, and a plurality of switching circuits 33 are mounted on the control board 31. The microcomputer 22 and the timing control IC 24 function as the control unit 15 in FIG. 1 and the plurality of operational amplifiers 32 and the plurality of switching circuits 33 function as the gradation reference voltage generation circuit 14 illustrated in FIG. 1.

The operational amplifier 32 outputs one gradation reference voltage. The switching circuit 33 outputs any of the gradation reference voltages output from the operational amplifier 32 and the voltage VQ according to a control signal C2 output from the timing control IC 24. During the operation of the liquid-crystal display device 30, the switching circuit 33 is controlled so as to output the gradation reference voltage output from the operational amplifier 32.

When the control signal P1 that instructs the power cut-off is received, the microcomputer 22 outputs the control signal P2 that instructs the power cut-off to the timing control IC 24. When the control signal P2 is received, the timing control IC 24 switches the value of the control signal C2 such that the switching circuit 33 outputs the voltage VQ. Therefore, all the gradation reference voltages VH255 to VL255 become the voltage VQ from the plurality of switching circuits 33.

The timing control IC 24 outputs the control signal P3 that indicates the completion of preparing the power cut-off to the microcomputer 22 after switching the value of the control signal C2. When the control signal P3 is received, the microcomputer 22 cuts off the power of the gate driver 12 and the source driver 13 in accordance with the power sequence illustrated in FIG. 3.

As described above, in the liquid-crystal display device 30 in the present embodiment, the gradation reference voltage generation circuit includes a plurality of operational amplifiers 32 each of which respectively outputs one gradation reference voltage, and the plurality of switching circuits 33 each of which respectively outputs any of the gradation reference voltages output from the operational amplifier 32 and the voltage VQ. During the waiting time Tw, the control unit (the microcomputer 22 and the timing control IC 24) controls all the switching circuits 33 such that the voltage VQ is output. Therefore, according to the liquid-crystal display device 30 in the present embodiment, with regard to the liquid-crystal display device that generates the gradation reference voltage using the operational amplifiers, it is possible to effectively prevent the afterimages, the ghosting, and the flickerings caused by the remaining charge when the power is cut off.

Fourth Embodiment

Figure 8:
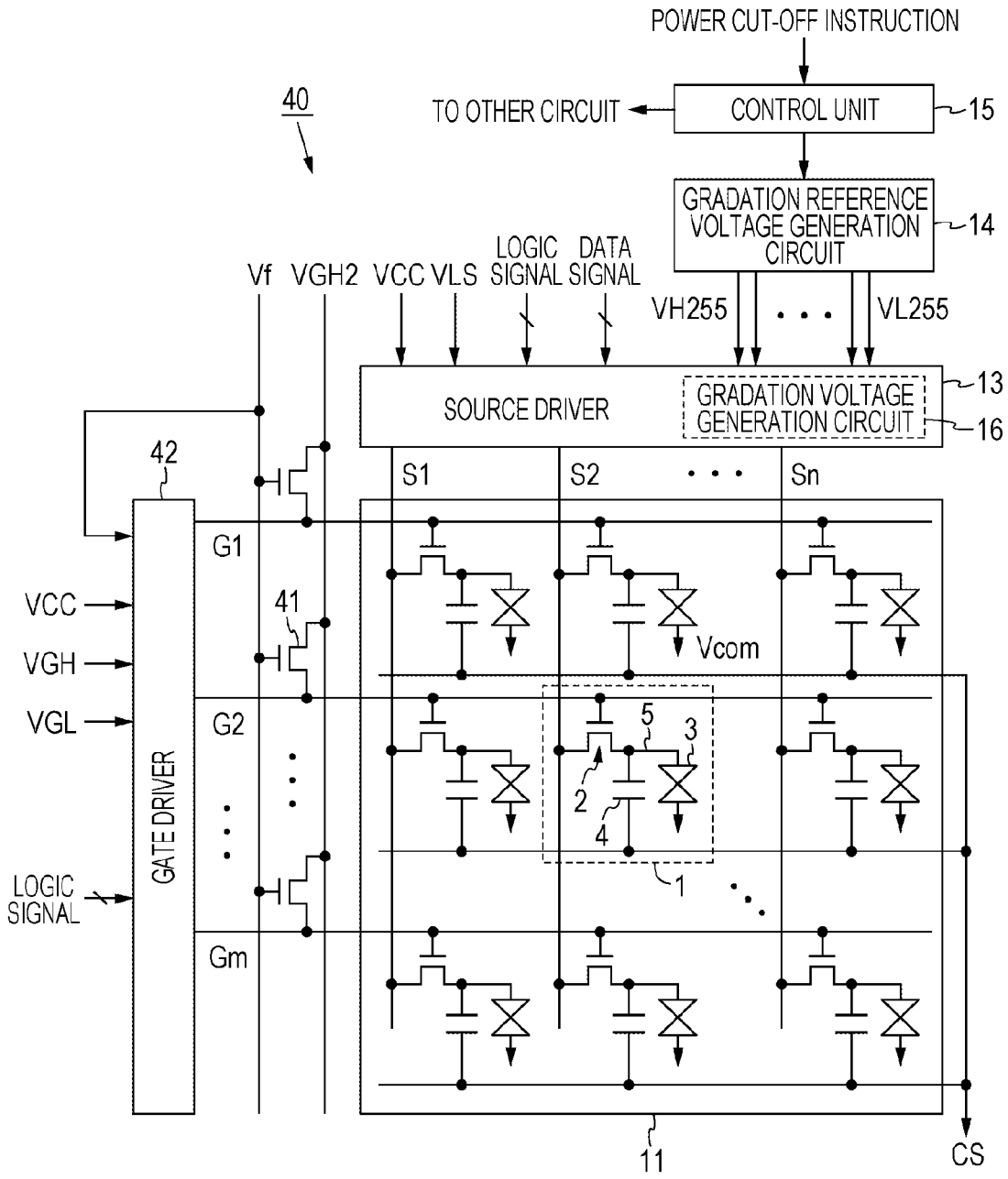
FIG. 8 is a block diagram illustrating a configuration of a liquid-crystal display device in a fourth embodiment of the present invention.

FIG. 8 is a block diagram illustrating a configuration of a liquid-crystal display device in a fourth embodiment of the present invention. The liquid-crystal display device 40 illustrated in FIG. 8 has a configuration in which a Vf line, a VGH2 line, and m pieces of TFTs 41 are added, and a change of replacing the gate driver 12 with a gate driver 42 is made to the liquid-crystal display device 10 (FIG. 1) in the first embodiment.

As illustrated in FIG. 8, the m pieces of TFTs 41 are provided corresponding to the gate lines G1 to Gm. A source terminal of the TFT 41 is connected to the corresponding gate line, drain terminals of the TFTs 41 are commonly connected to the VGH2 line, and gate terminals of the TFTs 41 are commonly connected to the Vf line.

The gate driver 42 is a device in which, when the voltage of the Vf line is at a high level, a function of making the output have a high impedance is added to the gate driver 12 in the first embodiment. When the voltage of the Vf line is at a low level, the gate driver 42 operates similarly to the gate driver 12. When the voltage of the Vf line is at the high level, the output of the gate driver 42 is in the high impedance.

Figure 9:
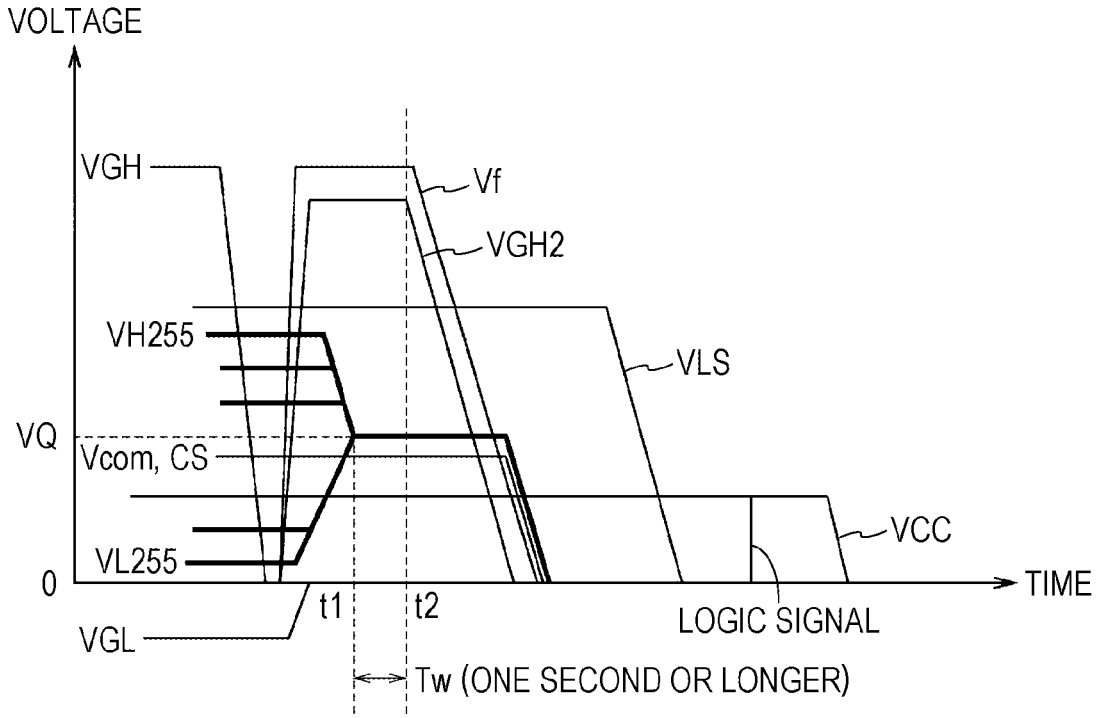
FIG. 9 is a diagram illustrating a power sequence of the liquid-crystal display device illustrated in FIG. 8 when the power is cut off.
Figure 10:
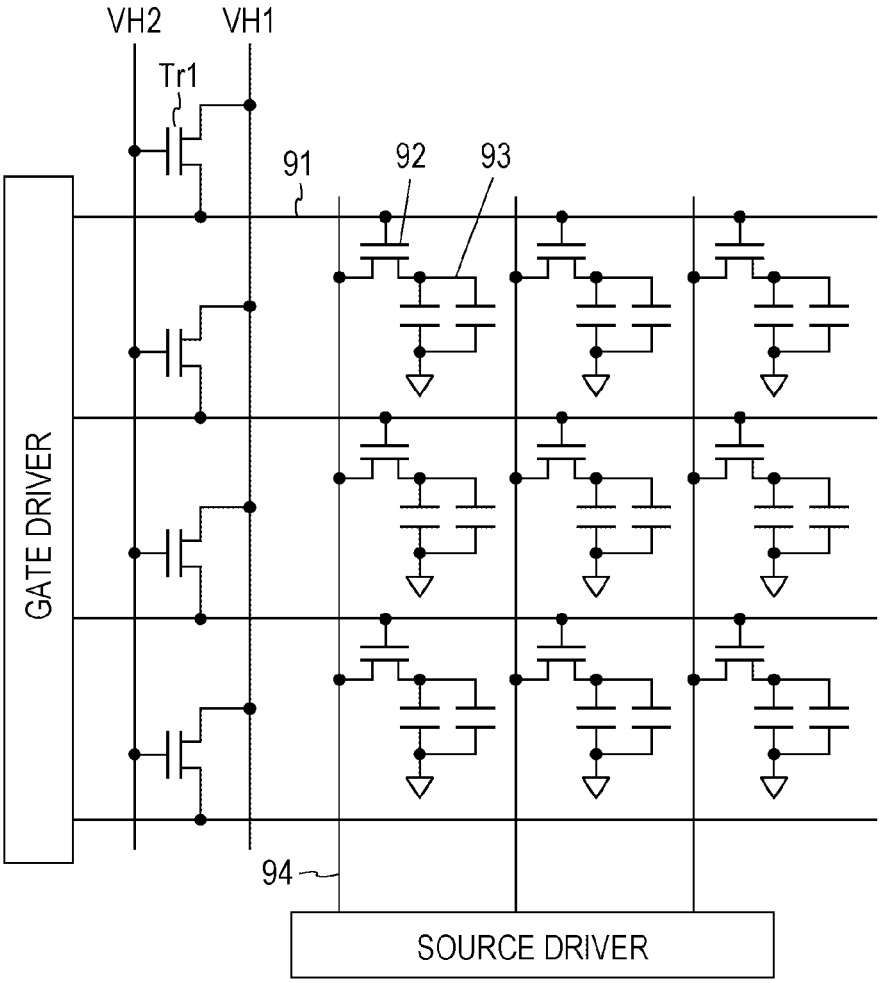
FIG. 10 is a block diagram illustrating a configuration of a liquid-crystal display device in the related art.
Figure 11:
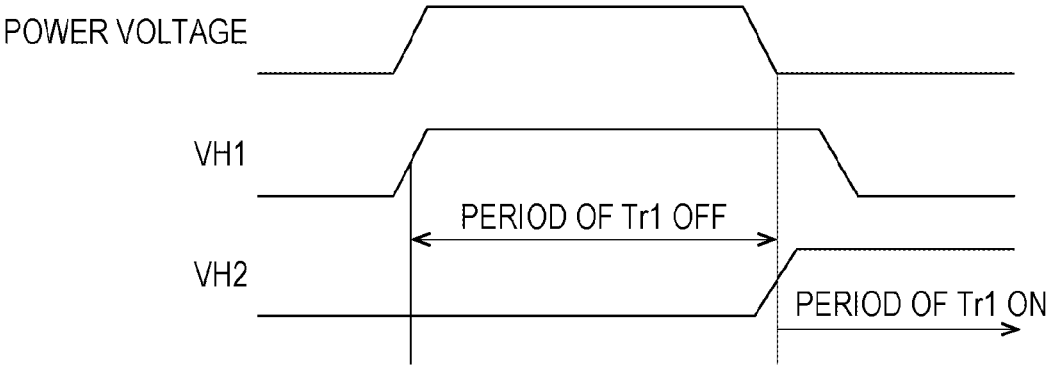
FIG. 11 is a signal waveform diagram of the liquid-crystal display device illustrated in FIG. 10 when the power is cut off.

FIG. 9 is a diagram illustrating a power sequence of the liquid-crystal display device 40 when the power is cut off. In FIG. 9, changes of the voltage illustrated in FIG. 3, voltage in the Vf line, and voltage in the VGH2 line when the power is cut off, are illustrated. In FIG. 9 also, the counter electrode voltage Vcom and the auxiliary capacity counter voltage CS are the same voltages.

In a power sequence illustrated in FIG. 9, before the waiting time Tw, the gate high voltage VGH changes to zero volts, the voltages of the Vf line and the voltage of the VGH2 line change to be at the high level, and the gate low voltage VGL changes to zero volts. Subsequently, at the point in time t1, all the gradation reference voltages VH255 to VL255 change to the voltage VQ. Subsequently, at the point in time t2, the voltage of the VGH2 line starts to change toward zero volts, and after the point in time t2, the voltage of the Vf line starts to change toward zero volts. Subsequently, the counter electrode voltage Vcom, the auxiliary capacity counter voltage CS, and all the gradation reference voltages VH255 to VL255 change to zero volts. Then, the source output power source voltage VLS, the voltage of the logic signal, and the logic power source voltage VCC change to zero volts in this order. As described above, in the present embodiment, the control unit 15 sets the waiting time Tw before the power of the source driver 13 is cut off and after the power of the gate driver 42 is cut off.

During the waiting time Tw, the operation of the gate driver 42 is stopped, but the source driver 13 operates in the same as the previous manner. In addition, during the waiting time Tw, all the TFTs 41 are in an ON state and all the gate lines G1 to Gm are selected, all the TFTs 2 included in the (m×n) pieces of pixel circuits 1 are in an ON state, and thus, the same voltages VQ are simultaneously written into the pixel electrodes 5 included in the (m×n) pieces of pixel circuits 1.

As described above, the liquid-crystal display device 40 in the present embodiment includes a plurality of transistors (TFTs 41) that correspond to the scanning lines (the gate lines G1 to Gm). One conductive terminal (source terminal) of the transistor is connected to the corresponding scanning line, the other conductive terminals (drain terminals) of all the transistors are commonly connected to a first control line (the VGH2 line), and the control terminals (gate terminals) of all the transistors are commonly connected to a second control line (the Vf line). The control unit 15 performs the control of: setting the waiting time Tw before the power of the data line driving circuit (the source driver 13) is cut off and after the power of the scanning line driving circuit (the gate driver 42) is cut off; applying the voltage (high level voltage) for selecting the scanning lines (the gate lines G1 to Gm) to the first control line during the waiting time Tw; and applying the voltage (high level voltage) for causing the transistors to be conductive to the second control line.

According to the liquid-crystal display device 40 in the present embodiment, during the waiting time Tw, all the scanning lines are selected in a state in which all the gradation reference voltages VH255 to VL255 that are references of the gradation voltages are the same voltage VQ. Therefore, by simultaneously writing the same voltage VQ into the pixel circuits 1 of the liquid-crystal panel 11 and discharging the charge remaining in the pixel circuits 1 during the waiting time Tw, it is possible to effectively prevent the afterimages, the ghosting, and the flickerings caused by the remaining charge when the power is cut off. Also for the liquid-crystal display device 40 in the present embodiment, the gradation reference voltage generation circuit 14 and the control unit 15 can be configured by the methods described in the second and third embodiments.

As described above, according to the liquid-crystal display device in the present invention, by making all the gradation reference voltages that are references of the gradation voltages be the same voltage before the power of the data line driving circuit is cut off, the same voltages are written into the pixel circuits of the liquid-crystal panel and the charge remaining in the pixel circuits are discharged, it is possible to effectively prevent the afterimages, the ghosting, and the flickerings caused by the remaining charge when the power is cut off. This effect is prominent in the liquid-crystal display device in which the TFT is formed using an oxide semiconductor such as IGZO.

INDUSTRIAL APPLICABILITY

The liquid-crystal display device in the present invention has characteristics in which the afterimages, the ghosting, and the flickerings caused by the remaining charge when the power is cut off can be effectively prevented, and can be used for the display units in various electronic apparatuses.

REFERENCE SIGNS LIST

1 PIXEL CIRCUIT
2, 41 TFT
3 LIQUID-CRYSTAL CAPACITOR
4 AUXILIARY CAPACITOR
5 PIXEL ELECTRODE
10, 20, 30, 40 LIQUID-CRYSTAL DISPLAY DEVICE
11 LIQUID-CRYSTAL PANEL
12, 42 GATE DRIVER (SCANNING LINE DRIVING CIRCUIT)
13 SOURCE DRIVER (DATA LINE DRIVING CIRCUIT)
14 GRADATION REFERENCE VOLTAGE GENERATION CIRCUIT
15 CONTROL UNIT
16 GRADATION VOLTAGE GENERATION CIRCUIT
21, 31 CONTROL BOARD
22 MICROCOMPUTER
23 POWER SUPPLY CIRCUIT
24 DYNAMIC CONTROL IC
25 DAC IC
32 OPERATIONAL AMPLIFIER
33 SWITCHING CIRCUIT

The invention claimed is:

1. A liquid-crystal display device which is an active matrix type liquid-crystal display device, comprising:

a liquid-crystal panel that includes a plurality of scanning lines, a plurality of data lines, and a plurality of pixel circuits;

a scanning line driving circuit that drives the scanning lines;

a gradation reference voltage generation circuit that generates a plurality of gradation reference voltages;

a data line driving circuit that generates a plurality of gradation voltages based on the plurality of gradation reference voltages, and drives the data lines using the generated gradation voltages; and a control unit that, when a power cut-off instruction is received, is configured to, set a waiting time having a length in which writing can be performed in multiple times with respect to all the pixel circuits included in the liquid-crystal panel before a power of the data line driving circuit is cut off, control the gradation reference voltage generation circuit such that all the plurality of gradation reference voltages become a same first voltage during the waiting time, determine the first voltage such that charge remaining in a pixel electrode of the pixel circuit is discharged when the first voltage is written to the pixel circuit, and change the plurality of gradation reference voltages to a ground level, after a voltage that is supplied to the scanning line drive circuit and turns on a transistor in the pixel circuit is changed to the ground level in accordance with the power cut-off instruction.

2. The liquid-crystal display device according to claim 1, wherein the control unit sets the waiting time before the power of the data line driving circuit is cut off and the power of the scanning line driving circuit is cut off.

3. The liquid-crystal display device according to claim 1, wherein the first voltage is a summed voltage in which a pull-in voltage generated at the time of writing into the pixel circuits is added to the voltage applied to a counter electrode of the liquid-crystal panel.

4. The liquid-crystal display device according to claim 1, wherein the first voltage is an average voltage of a positive lowest gradation reference voltage and a negative lowest gradation reference voltage.

5. The liquid-crystal display device according to claim 1, wherein a length of the waiting time is equal to or longer than one second.

6. The liquid-crystal display device according to claim 1, wherein the gradation reference voltage generation circuit includes a plurality of D/A converters each of which converts assigned digital values to one gradation reference voltage, and wherein, during the waiting time, the control unit assigns the digital values corresponding to the first voltage to all the D/A converters included in the gradation reference voltage generation circuit.

7. The liquid-crystal display device according to claim 1, wherein the gradation reference voltage generation circuit includes a plurality of operational amplifiers each of which outputs one gradation reference voltage and a plurality of switching circuits each of which outputs any of gradation reference voltages output from the operational amplifiers and the first voltage, and wherein, during the waiting time, the control unit controls all the switching circuits so as to output the first voltage.

8. The liquid-crystal display device according to claim 1, further comprising:

a plurality of transistors that correspond to the scanning lines, wherein one conductive terminal of the transistor is connected to a corresponding scanning line, the other conductive terminals of all the transistors are commonly connected to a first control line, and the control terminals of all the transistors are commonly connected to a second control line, and wherein the control unit performs the control of setting the waiting time before the power of the data line driving circuit is cut off and after the power of the scanning line driving circuit is cut off; applying the voltage for selecting the scanning lines to the first control line during the waiting time; and applying the voltage for causing the transistors to be conductive to the second control line.

* * * * *